US012091847B1

(12) United States Patent
Bacchus et al.

(10) Patent No.: US 12,091,847 B1
(45) Date of Patent: Sep. 17, 2024

(54) SELECTIVE EASY CLEAN DRAIN HAIR FILTER

(71) Applicants: Gibran Bacchus, Guelph (CA); Bibi Natasha Bacchus, Guelph (CA)

(72) Inventors: Gibran Bacchus, Guelph (CA); Bibi Natasha Bacchus, Guelph (CA)

(73) Assignee: Majig Designs Inc., Guelph (CA)

( * ) Notice: Subject to any disclaimer, the term of this patent is extended or adjusted under 35 U.S.C. 154(b) by 0 days.

(21) Appl. No.: 18/335,913

(22) Filed: Jun. 15, 2023

(51) Int. Cl.
*E03C 1/262* (2006.01)

(52) U.S. Cl.
CPC ..... *E03C 1/262* (2013.01)

(58) Field of Classification Search
CPC . E03C 1/26; E03C 1/262; E03C 1/264; A45D 44/16
USPC ..... D23/261
See application file for complete search history.

(56) References Cited

U.S. PATENT DOCUMENTS 1,996,279 A * 4/1935 Dillon ..... E03C 1/264 D23/209
2,690,569 A * 10/1954 Kozerski ..... E03C 1/264 4/292
3,268,920 A * 8/1966 Beer ..... E03C 1/264 210/163
3,959,831 A * 6/1976 Hendricks ..... E03C 1/264 4/DIG. 14
4,418,432 A * 12/1983 Vidal ..... A47K 1/14 428/34.1
4,671,976 A * 6/1987 Vidal ..... E03C 1/264 4/293
5,271,108 A * 12/1993 Wicke ..... E03C 1/26 4/292
D550,819 S * 9/2007 Seehoff ..... D23/261

FOREIGN PATENT DOCUMENTS

JP 2005264576 A * 9/2005
KR 20080057911 A * 6/2008

* cited by examiner

*Primary Examiner* — Erin Deery

(57) ABSTRACT

This invention is a selective drain hair filter, which allows debris to bypass the filter. The invention contains a circular disk with a centrally positioned hole that sits around a drain flange, held in place by the larger diameter posts and the pressure of flowing water over the circular disk with central hole and sloped base. Water flows around posts of varying heights and diameters and a circular wall with cutout channels. Hair flowing around the posts gets twisted into rotation by the upwardly sloped base and by hitting the wall structure and posts next to the channels. This device selectively filters hair to prevent unsightly debris build up found on other devices. It contains no discrete filtration apertures for hair and debris to get stuck within, allowing easier cleaning. The simpler and low-profile design is more aesthetically pleasing and less prone to encouraging mold growth.

7 Claims, 4 Drawing Sheets

SELECTIVE EASY CLEAN DRAIN HAIR FILTER

CROSS-REFERENCE TO RELATED APPLICATIONS

This application claims the benefit of U.S. Provisional Patent Application Ser. No. 63/355,646, filed 2022 Jun. 26th by the present inventors. The entire disclosure is included herein in its entirety at least by reference.

PRIOR ART

The following is a tabulation of some prior art that presently appears relevant:

| U.S Patents | | | |
|---|---|---|---|
| Pat. No. | Kind Code | Issue Date | Patentee |
| U.S. Pat. No. 3,972,078 | A | 1976 Aug. 3 | Maki |
| U.S. Pat. No. 4,418,432 | A | 1983 Dec. 6 | Vidal |
| U.S. Pat. No. 10,344,460 | B1 | 2019 Jul. 9 | Karnegie |
| USD650471 | S | 2011 Dec. 13 | Du |
| USD853534S | S | 2019 Jul. 9 | Helton |
| U.S. Pat. No. 10,791,819 | B2 | 2020 Oct. 6 | Caccamise |

| Foreign Patents | | | |
|---|---|---|---|
| Patent Number | Kind Code | Issue Date | Patentee |
| JP2005264576A | A | 2005 Sep. 23 | Ogawa |
| KR20080057911A | A | 2008 Jun. 25 | Lee |

BACKGROUND OF THE INVENTION

Field of the Invention: The present invention relates to the field of bathroom fixtures, specifically bathtub or shower or sink plumbing accessories. It pertains to a hair filter designed preferably for use on a bathtub or shower or sink or similar drain flange to selectively prevent hair and larger debris or jewelry from clogging the drain.

Description of Related Art: Currently, there are several solutions for filtering hair in bathtubs or showers or sinks and preventing drainpipe clogs. Some of these solutions require removal of the existing drain stopper. This is cumbersome, often requires tools, and affects the original aesthetic look of the tub or shower or sink. Current solutions discovered on the market don't attempt to selectively filter only hair, letting other debris bypass the filter, without using discrete filtration apertures, while simultaneously being easy to clean and not requiring tools to install. They utilize filtration holes, screens, slats, slots, meshes, bristles, or other discrete filtration apertures which can trap debris along with hair. This becomes unsightly, impacts water flow, and is also difficult to clean when hair and debris tangles in the crevices and apertures. This design complexity also makes such devices more difficult to manufacture.

Karnegie, in U.S. Pat. No. 10,344,460 (2019) shows one device that utilizes filtration holes and has a mechanism to hide hair below the level of the tub or sink drain flange. Subsequently one does not know when the water flow is restricted or clogged until the water starts to back up in the tub or sink upon commencement of showering or usage. This device requires tools for the installation and removal of the existing functional drain stopper. Its complexity would be more difficult to manufacture.

Helton, in U.S. Pat. No. D853534S (2019) shows a device which has a plurality of complex slats which would be difficult to clean when hair and debris gets into the slats. It lacks selective filtration or a sloped based to prevent lifting by water pressure.

Vidal, in U.S. Pat. No. 4,418,432A (1983) shows a device that sits around the drain flange utilizing spikes or bristles on a hollow semicylindrical form with a net like mesh structure. This device is not a selective filter and would be more difficult to clean once hair gets tangled in the bristles and mesh.

Maki, in U.S. Pat. No. 3,972,078 (1976) shows a device that is geared primarily towards preventing the loss of objects down the drain rather than catching hair. The toroidal shape would be more difficult to clean should hair become embedded, as there is no means to lift the hair upwards for easy cleaning.

Caccamise, in U.S. Pat. No. 10,791,819 (2020) shows a device that has a plurality of elongated posts. However, it does not selectively filter hair, and has discrete holes in the body which are more difficult to clean when hair is entangled. It is not designed for use with drains.

Du, in U.S. Pat. No. D650471 (2011) shows a device with horizontal spikes or bristles which requires removal of the existing tub drain stopper hardware. In addition, it would be more difficult to clean once hair gets wrapped around the bristles.

Ogawa, in Japanese Pat. No. JP2005264576A (2005) shows a complex device that consists of multiple parts rather than a simpler unitary body. It has a base which is flat rather than sloped with a plurality of elongated members for hair filtration. The elongated members appear to be of the same height. If the elongated members we shorter at higher elevations, there would be less resistance to water flow once the lower portion gets clogged with hair. Ogawa's device also has a restrictive top cover and support base which results in three discrete aperture openings for water to flow rather than having a central opening to match the drain flange diameter. This device would also interfere with the operation of the drain stopper. Most importantly, Ogawa's device is meant for use with bathrooms that have a drain with slit shaped openings rather than those that have a tub or sink drain stopper mechanism.

Lee, in Korean Pat. No. KR20080057911A (2008) shows a device with a square or washer shaped base. The device has some slope at the edges but not all the way towards the centrally positioned drain hole. It has tooth like objects to catch hair and lacks a plurality of elongated members. The tooth like objects do not abut against the drain stopper such as when used in a bathtub. It lacks any inner wall or channels for impacting water flow. Some embodiments also use discrete holes and slats.

What is needed is a selective easy clean device that has a low profile and when combined with the right material and color, blends in well with existing tub and sink hardware. It should have little impact on the original tub or sink hardware aesthetics. It should be less complex to manufacture and require minimal material to produce. It should have a small footprint in order to sit on the drain flange and therefore be less likely to foster mold growth around the tub.

SUMMARY OF THE INVENTION

In accordance with one embodiment is a selective easy clean bathtub or shower or sink unitary drain hair filter for trapping hair, jewelry, and larger objects from entering the drain of bathtubs showers, sinks or the like having a liftable drain stopper and flange, while allowing other debris to flow down the drain. The unitary drain hair filter is made up of any resilient material such as TPU, rubber, plastic, or silicone etc. It contains a circular disk with a centrally positioned hole having an inner diameter sufficient as to not impede water flow via a bathtub or sink or similar fixture drain flange, and an outer diameter sufficient to sit within the drain flange. The circular disk with a centrally positioned hole has a gradually increasing sloped base in either a linear or nonlinear fashion from the outer edge towards the centrally positioned hole. The sloped base prevents lifting of the device due to the pressure of water flowing above it. It also creates a change in water flow speed and subsequent turbulence to encourage hair to bend and twist. There is an alternating pattern of a plurality of smaller and larger elongated posts of variable heights for hair entanglement. The larger posts abut up against the drain stopper to also help keep the device in place. The smaller posts of variable heights allow an increase in water flow should the lower elevations of the device become clogged. Fillets or chamfers may be used where the base of the posts originate on the sloped base for increased strength. A circular vertical wall structure of variable thickness and height having cut out channels of semicircular shape of variable slope and taper in this embodiment, exists behind the smaller posts. Hair is encouraged to become twisted, wrapping around the elongated posts by the turbulence and impacts created by the combination of a sloped base, circular wall, and elongated posts, in concert with the Coriolis effect of water flow down the drain. At the same time water and debris is encouraged to be channeled and flow around the posts and over the wall and cut out channels in a nonlinear path. These components are all part of a unitary device that is designed to selectively filter hair but allow most other debris to bypass it. This hair filter does not contain any filtration holes or screens or similar apertures, and does not require modifying the existing drain stopper, and has easy clean posts which may be tapered, with a smaller cross section towards the top for easier hair removal. Hair twists and wraps around the posts which are circular and tapered in this embodiment but can vary in shape, and are easily cleaned by lifting upwards as there are no screens or holes or meshes or apertures for hair to become entangled in.

Advantages: It would be desirable to have a unitary bathtub or shower or sink drain filter that selectively filters hair while allowing other debris to flow freely down the drain. Furthermore, it would be desirable to have a bathtub or shower or sink drain hair filter that does not require removal of existing tub drain hardware and will not interfere with the tub drain stopper mechanism, while having minimal impact on the aesthetic appearance of the existing hardware. It would also be desirable for such a device to have a minimal footprint as to sit upon the drain flange, thereby being less prone to the growth of mold. Still, further, it would also be desirable to have a bathtub or shower or sink drain hair filter that does not contain any discrete filtration apertures such as holes, screens, slats, slots or meshes or bristles to get clogged with hair and debris making it easier and quicker to clean. Yet further it would be desirable to have a device with the visibility of hair trapped above the tub line, allowing the user to clean it prior to the tub becoming clogged with standing water. This would ensure optimal water flow is maintained. A device that has less surface area at the higher elevations, once the lower elevations become clogged with hair, would also be desirable. The disclosed device advantageously fills these needs addressing the aforementioned deficiencies by providing an easy clean more selective bathtub or shower or sink drain hair filter which allows other debris to flow down the drain.

DRAWINGS—REFERENCE NUMERALS

Reference Numerals

Figure 1:
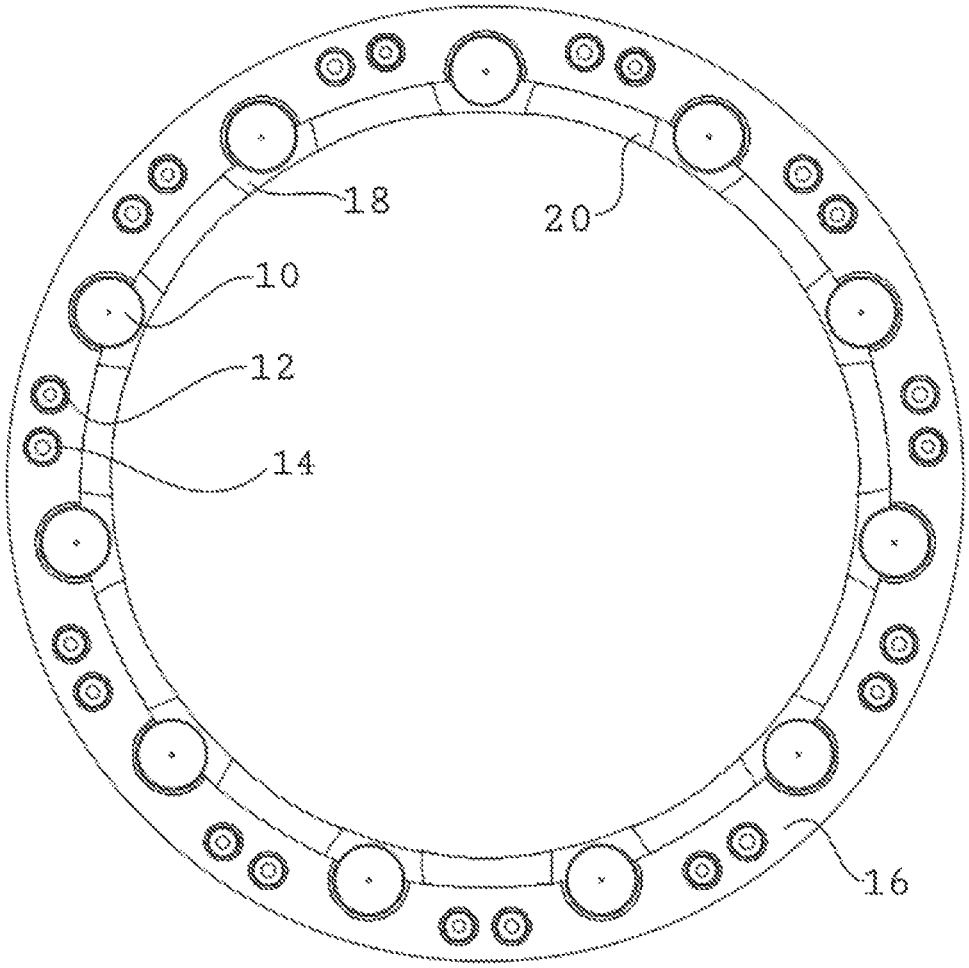
FIG. 1. —Selective Hair filter Top View in accordance with an embodiment of the present disclosure.

10 larger posts
12 smaller posts of longer length than post 14 in this embodiment
14 smaller posts of shorter length than post 12 in this embodiment
16 circular disk with a centrally positioned hole and sloped base
18 circular wall structure
20 cut out channels in circular wall structure
22 drain stopper
24 drain flange

DETAILED DESCRIPTION OF THE INVENTION

Figure 6:
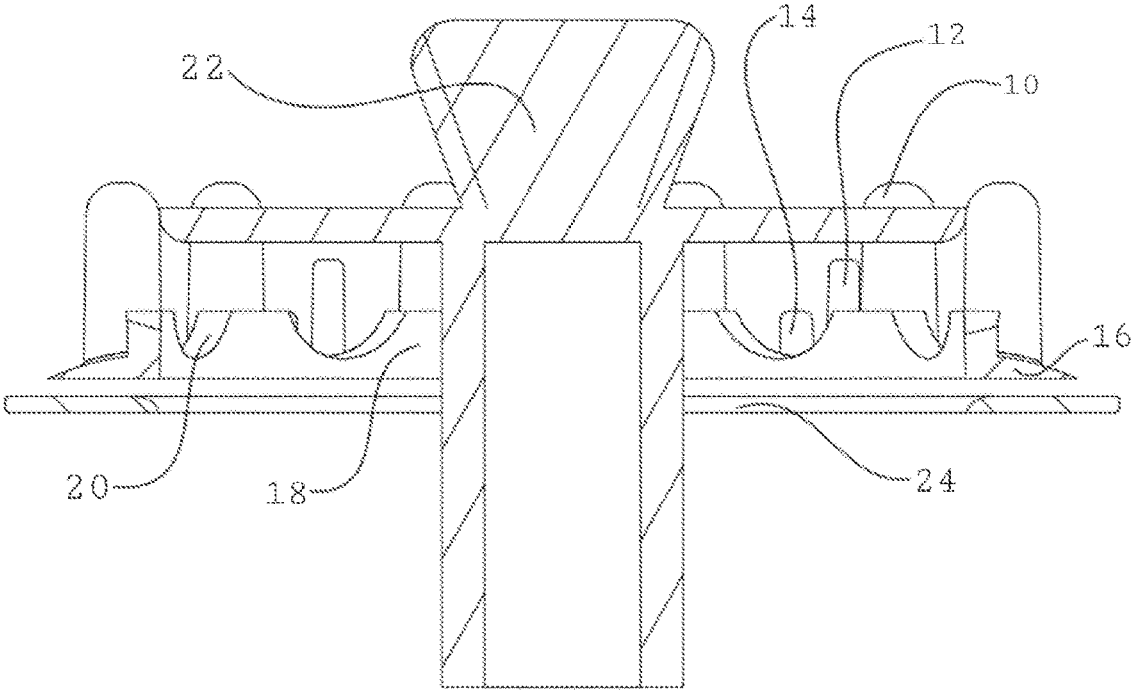
FIG. 6. —Selective Hair filter Vertical Cross Sectional View of hair straining device of FIG. 5 taken along section line 6-6 of FIG. 5.

Referring to FIG. 1, a diagram is shown illustrating a top view of the selective bathtub or shower or sink hair filter device in accordance with an embodiment of the present invention. Shown is a thin circular disk with a centrally positioned hole and sloped base 16, sloped upwards from the outer to inner diameter towards the bathtub or shower or sink drain hole location. This circular disk with centrally positioned hole and sloped base 16 is of a small enough profile to sit on the tub drain flange 24, encouraging better airflow and less potential mold growth. The hair filter includes larger posts 10 spaced in a circular pattern on or partially cantilevered off the circular disk with centrally positioned hole and sloped base 16. Smaller posts 12 and 14 are spaced in a circular pattern in between the larger posts 10 on the circular disk with centrally positioned hole and sloped base 16 with sufficient height to abut up against the drain stopper 22 as shown in FIG. 6. A circular wall 18 exists closer to the inner diameter of the circular disk with sloped base 16. Cut out channels 20, semicircular and of variable radius, slope and taper in this embodiment are cut into the circular wall 18 in between the larger posts 10 and behind the smaller posts 12 and 14 for directing water flow and debris down the drain. The larger posts 10 work in concert with the smaller posts 12 and 14 to catch any moving hair before it can enter the cut-out channels 20. Hair that flows past to the left of post 12 or to the right of post 14 will become deflected by the partial section of the vertical circular wall 18 in combination with the turbulence created by the circular disk with sloped base 16, encouraging them to twist and become tangled on posts 10, or 12, or 14. Other debris will flow down the drain over the circular wall 18 and via the cut out channels 20. The diameters, heights, and spacing patterns for posts 10, or 12, or 14 can be varied to achieve different water flow and filtration rates. The profile of posts 10, or 12, or 14 can also be made of different shapes such as squares, triangles etc. Cut out channels 20 can be made of different shapes such as squares, triangles etc. The slope and taper of the cut out channels 20 are variable as to impact water flow turbulence, with the shape being selected based on the desired performance. The slope of the circular disk with sloped base 16 can be varied in a linear or nonlinear pattern to adjust the desired flow rate and subsequent twisting of hair. It should further be noted that the unitary hair filter can be made of various resilient materials such as TPU, plastic, silicone, rubber, etc. Materials of textures that attract and grab hair are preferable.

Figure 2:
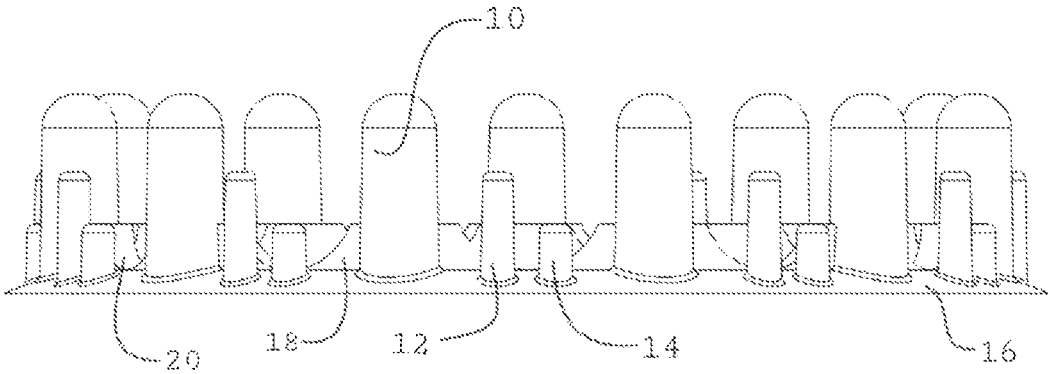
FIG. 2. —Selective Hair filter Side View of hair straining device of FIG. 1.

Referring now to FIG. 2, a diagram is shown illustrating a side view of the selective bathtub or shower or sink hair filter device in accordance with one embodiment of the invention. As shown, the hair filter includes larger posts 10 spaced in a circular pattern on the circular disk with centrally positioned hole and sloped base 16, which has an upwards slope towards the inner diameter of the circular disk with centrally positioned hole 16, where the tub or sink drain hole is located. Smaller tapered posts 12 and 14 of FIG. 2 are spaced in a circular pattern in between the larger posts 10. In this embodiment posts 12 and 14 are of different heights so once water starts to back up due to clogging on the lower level of the hair filter, water that overflows the height of posts 14 will encounter less resistance to flow. However, the heights of posts 12 and 14 are variable and can be the same height in order to change the filtration profile. The spacing of all posts, the number of posts and their heights can be changed to suit different water flow and flange diameter criteria. A circular wall 18 exists closer to the inner diameter of the circular disk with centrally positioned hole and sloped base 16, but can be relocated at different positions on the circular disk with sloped base 16. Cut out channels 20, semicircular in this embodiment, are cut into the circular wall 18 for directing water flow traveling in a swirling pattern in concert with the Coriolis effect.

Figure 3:
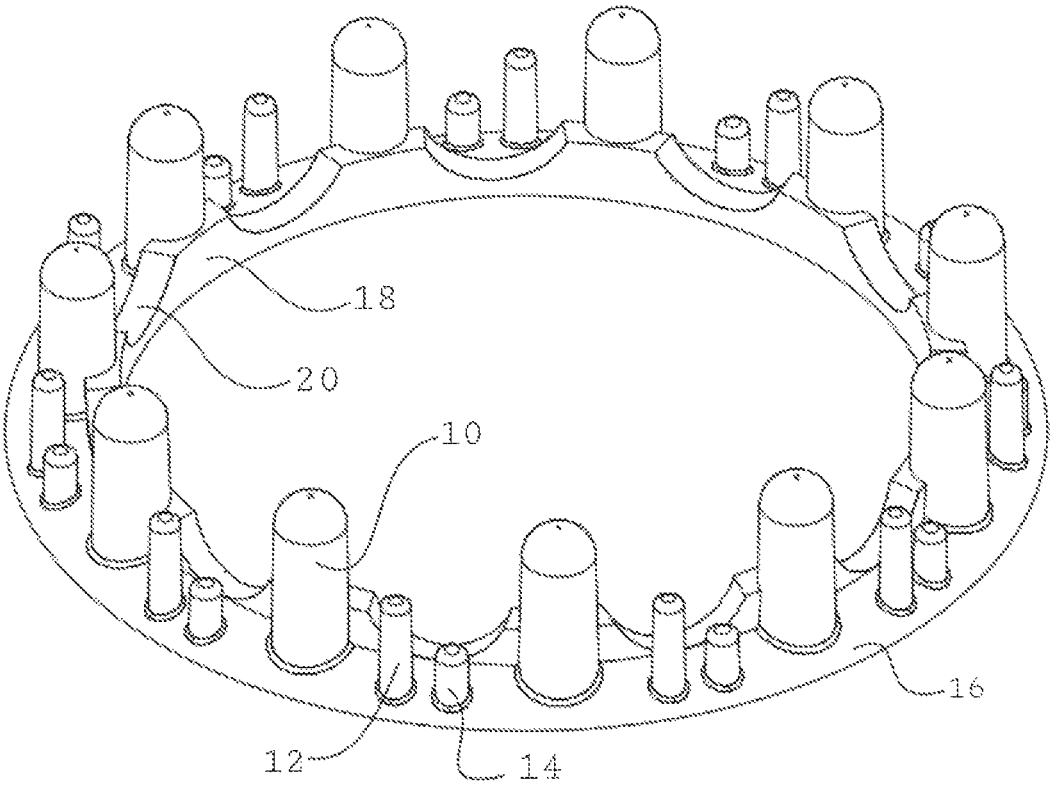
FIG. 3. —Selective Hair filter Isometric View of hair straining device of FIG. 1.

Referring now to FIG. 3, a diagram is shown illustrating an isometric view of the selective bathtub or shower or sink drain hair filter device in accordance with one embodiment of the invention. The posts 10, or 12, or 14 in this embodiment can include draft angles for easier hair removal as well as manufacturing. The base of the post may also include chamfer angles or fillets for greater strength. The upwards slope circular disk with centrally positioned hole and sloped base 16 can be varied to increase the obstruction to the flow of water, thereby increasing downwards pressure on base, helping to keep the entire filter in place and preventing lifting. This downward force creates turbulence resulting in increased twisting forces on hair.

Figure 4:
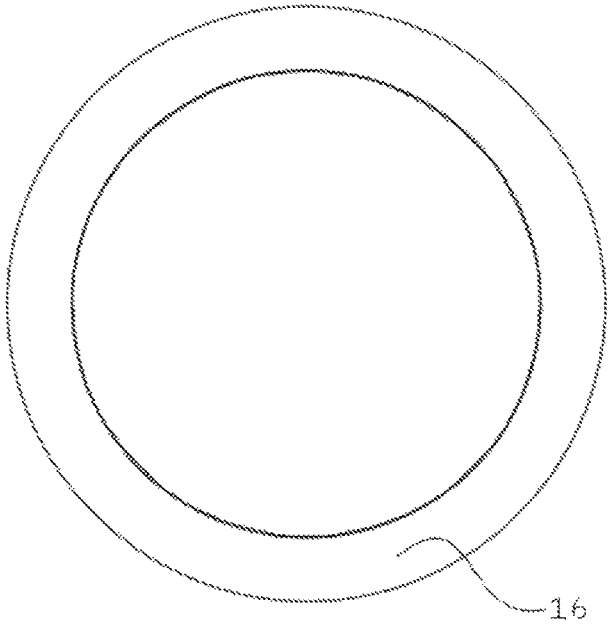
FIG. 4. —Selective Hair filter Bottom View of hair straining device of FIG. 1.

Referring now to FIG. 4, a diagram is shown illustrating a bottom view of the selective bathtub or shower or sink drain hair filter device in accordance with one embodiment of the invention. The diameters of the circular disk with centrally positioned hole and sloped base 16 can be varied to suit the required application.

Figure 5:
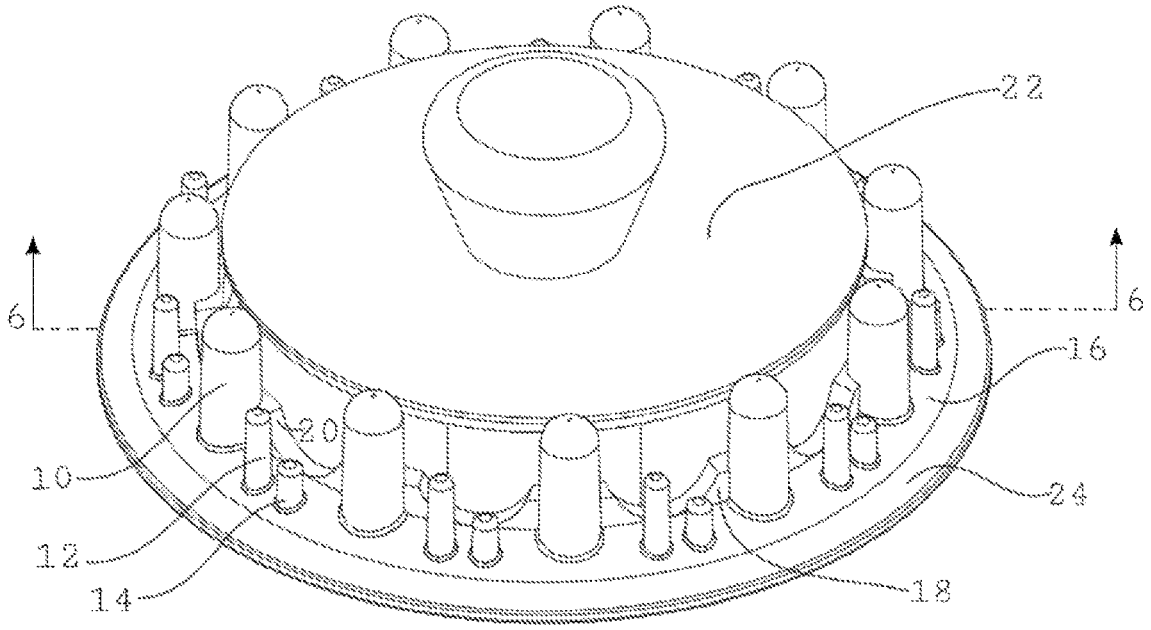
FIG. 5. —Selective Hair filter Isometric View of hair straining device of FIG. 1 sitting on a drain flange with drain stopper.

Referring now to FIG. 5, a diagram is shown illustrating an isomeric view of the selective bathtub or shower or sink drain hair filter device sitting on a bathtub or sink flange 24 around the drain stopper 22 in accordance with one embodiment of the invention. The device does not interfere with or require removal of the existing drain stopper 22.

Referring now to FIG. 6, a diagram is shown illustrating a vertical cross-sectional view of the selective bathtub or shower or sink drain hair filter device sitting on a bathtub or sink flange 24 around the drain stopper 22 in accordance with one embodiment of the invention. It is taken from FIG. 5 along section line 6-6. The drain stopper 22 abuts up against the unitary body hair filter larger posts 10.

Conclusion, Ramifications, and Scope: What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing. These measurements and spacing patterns are merely illustrative and selective drain hair filters of any diameter and spacing patterns that include the features described herein are intended to be within this disclosure and make up the overall invention, which has many different embodiments. The device can be made of various material with textures that attract and trap hair. Current 3D printed materials have textures that accomplish this quite well. The disclosed device is unique when compared with other known devices and solutions because it provides: Selective filtration of hair while allowing other debris to flow down the drain; is easier to clean as hair doesn't get trapped in holes, screens, or other apertures; doesn't require tools or modification of existing drain hardware to install; trapped hair is visible allowing pre-emptive cleaning before the device clogs or water flow is impacted; has a simple design using minimal material which is easier to manufacture; has an aesthetically pleasing low profile design that is less likely to encourage mold growth, and blends well with existing tub and sink hardware; has less resistance to water flow at higher elevations due to the lower heights of the smaller diameter posts. The drawings and specific descriptions of the drawings, as well as any specific or alternative embodiments discussed, are intended to be read in conjunction with the entirety of this disclosure.

What is claimed is:

1. A hair filter for selectively trapping hair and jewelry from entering a drain of a bathroom fixture, the drain having a stopper and a flange, while allowing water and other debris to flow through the drain, the filter comprising:

a unitary hair filter body formed of a resilient material, said body being a circular disk with a centrally positioned hole, the body having an inner edge defining an inner diameter which allows water to drain therethrough and an outer edge defining an outer diameter which allows said body to sit within said flange, said body having a sloped wall which increases from the outer edge toward the inner edge, wherein downward pressure of water flow on the body helps to maintain the body in position;

a plurality of first elongated posts extending upwardly from said sloped wall, each first post having a length as to abut the stopper and generally geometric shape;

a plurality of second elongated posts extending upwardly from said sloped wall, each second post having a different length than the first and generally geometric shape;

wherein the plurality of second elongated posts are positioned in between the plurality of first elongated posts in order to cause hair entanglement;

a wall extending upwardly, placed between the inner and outer edges of the body, said wall having a plurality of channels defined by notches of a geometric shape extending from a top edge of said wall, wherein water flow around the plurality of first and second elongated posts and wall causes hair entanglement such that hair is trapped while other debris flows around the plurality of first and second posts and over the wall and through plurality of channels.

2. The hair filter of claim 1, wherein tops of the plurality of first and second elongated posts taper to enable removal of entangled hair.

3. The hair filter of claim 1, wherein the lengths of the plurality of second elongated posts are the same.

4. The hair filter of claim 1, wherein the lengths of the plurality of second elongated posts are different.

5. The hair filter of claim 1, wherein the lengths of the plurality of first elongated posts are the same.

6. The hair filter of claim 1, wherein the lengths of the plurality of first elongated posts are different.

7. The hair filter of claim 1, wherein the centrally positioned hole is the only drainage aperture.

* * * * *